US007710040B2

(12) United States Patent
Gorrell et al.

(10) Patent No.: US 7,710,040 B2
(45) Date of Patent: May 4, 2010

(54) SINGLE LAYER CONSTRUCTION FOR ULTRA SMALL DEVICES

(75) Inventors: Jonathan Gorrell, Gainesville, FL (US); Mark Davidson, Florahome, FL (US); Jean Tokarz, Hawthorne, FL (US); Andres Trucco, Gainesville, FL (US)

(73) Assignee: Virgin Islands Microsystems, Inc., St. Thomas, VI (US)

( * ) Notice: Subject to any disclaimer, the term of this patent is extended or adjusted under 35 U.S.C. 154(b) by 894 days.

(21) Appl. No.: 11/418,080

(22) Filed: May 5, 2006

(65) Prior Publication Data

US 2007/0259488 A1 Nov. 8, 2007

(51) Int. Cl.
*H01J 25/10* (2006.01)

(52) U.S. Cl. ..... 315/5.39; 315/39.51; 315/500; 315/505

(58) Field of Classification Search ..... 315/3.5–3.6, 315/5.39, 39.51, 500, 501, 505; 250/222.2, 250/286, 396 R, 399, 400, 492.24, 492.3, 250/493.1, 494.1, 504 R; 376/156
See application file for complete search history.

(56) References Cited

U.S. PATENT DOCUMENTS

| | | | | |
|---|---|---|---|---|
| 1,948,384 | A | 2/1934 | Lawrence | |
| 2,307,086 | A | 1/1943 | Varian et al. | |
| 2,431,396 | A | 11/1947 | Hansell | |
| 2,473,477 | A | 6/1949 | Smith | |
| 2,634,372 | A | 4/1953 | Salisbury | |
| 2,932,798 | A | 4/1960 | Kerst et al. | |
| 2,944,183 | A | 7/1960 | Drexler | |
| 2,966,611 | A | 12/1960 | Sandstrom | |
| 3,231,779 | A | 1/1966 | White | |
| 3,274,428 | A * | 9/1966 | Harris | 315/3.6 |
| 3,297,905 | A | 1/1967 | Rockwell et al. | |
| 3,315,117 | A | 4/1967 | Udelson | |
| 3,387,169 | A * | 6/1968 | Farney | 315/3.5 |
| 3,543,147 | A | 11/1970 | Kovarik | |
| 3,546,524 | A * | 12/1970 | Stark | 315/5.41 |

(Continued)

FOREIGN PATENT DOCUMENTS

EP 0237559 B1 12/1991

(Continued)

OTHER PUBLICATIONS

International Search Report and Written Opinion mailed Nov. 23, 2007 in International Application No. PCT/US2006/022786.

(Continued)

*Primary Examiner*—Douglas W Owens
*Assistant Examiner*—Tung X Le
(74) *Attorney, Agent, or Firm*—Davidson Berquist Jackson & Gowdey LLP

(57) ABSTRACT

An array of ultra-small structures of between ones of nanometers to hundreds of micrometers in size that can be energized to produce at least two different frequencies of out put energy or data, with the ultra small structures being formed on a single conductive layer on a substrate. The array can include one row of different ultra small structures, multiple rows of ultra small structures, with each row containing identical structures, or multiple rows of a variety of structures that can produce all spectrums of energy or combinations thereof, including visible light.

11 Claims, 7 Drawing Sheets

U.S. PATENT DOCUMENTS 3,560,694 A 2/1971 White
3,571,642 A 3/1971 Westcott
3,586,899 A 6/1971 Fleisher
3,761,828 A 9/1973 Pollard et al.
3,886,399 A 5/1975 Symons
3,923,568 A 12/1975 Bersin
3,989,347 A 11/1976 Eschler
4,053,845 A 10/1977 Gould
4,160,189 A * 7/1979 Tran et al. ..... 315/5.41
4,282,436 A 8/1981 Kapetanakos
4,296,354 A * 10/1981 Neubauer ..... 315/3.5
4,450,554 A 5/1984 Steensma et al.
4,453,108 A 6/1984 Freeman, Jr.
4,482,779 A 11/1984 Anderson
4,528,659 A 7/1985 Jones, Jr.
4,589,107 A 5/1986 Middleton et al.
4,598,397 A 7/1986 Nelson et al.
4,630,262 A 12/1986 Callens et al.
4,652,703 A 3/1987 Lu et al.
4,661,783 A 4/1987 Gover et al.
4,704,583 A 11/1987 Gould
4,712,042 A 12/1987 Hamm
4,713,581 A 12/1987 Haimson
4,727,550 A 2/1988 Chang et al.
4,740,963 A 4/1988 Eckley
4,740,973 A 4/1988 Madey
4,746,201 A 5/1988 Gould
4,761,059 A 8/1988 Yeh et al.
4,782,485 A 11/1988 Gollub
4,789,945 A 12/1988 Niijima
4,806,859 A 2/1989 Hetrick
4,809,271 A 2/1989 Kondo et al.
4,813,040 A 3/1989 Futato
4,819,228 A 4/1989 Baran et al.
4,829,527 A 5/1989 Wortman et al.
4,838,021 A 6/1989 Beattie
4,841,538 A 6/1989 Yanabu et al.
4,864,131 A 9/1989 Rich et al.
4,866,704 A 9/1989 Bergman
4,866,732 A 9/1989 Carey et al.
4,873,715 A 10/1989 Shibata
4,887,265 A 12/1989 Felix
4,890,282 A 12/1989 Lambert et al.
4,898,022 A 2/1990 Yumoto et al.
4,912,705 A 3/1990 Paneth et al.
4,932,022 A 6/1990 Keeney et al.
4,981,371 A 1/1991 Gurak et al.
5,023,563 A 6/1991 Harvey et al.
5,036,513 A 7/1991 Greenblatt
5,065,425 A 11/1991 Lecomte et al.
5,113,141 A 5/1992 Swenson
5,121,385 A 6/1992 Tominaga et al.
5,127,001 A 6/1992 Steagall et al.
5,128,729 A 7/1992 Alonas et al.
5,130,985 A 7/1992 Kondo et al.
5,150,410 A 9/1992 Bertrand
5,155,726 A 10/1992 Spinney et al.
5,157,000 A 10/1992 Elkind et al.
5,163,118 A 11/1992 Lorenzo et al.
5,185,073 A 2/1993 Bindra
5,187,591 A 2/1993 Guy et al.
5,199,918 A 4/1993 Kumar
5,214,650 A 5/1993 Renner et al.
5,233,623 A 8/1993 Chang
5,235,248 A 8/1993 Clark et al.
5,262,656 A 11/1993 Blondeau et al.
5,263,043 A 11/1993 Walsh
5,268,693 A 12/1993 Walsh
5,268,788 A 12/1993 Fox et al.
5,282,197 A 1/1994 Kreitzer
5,283,819 A 2/1994 Glick et al.
5,293,175 A 3/1994 Hemmie et al.
5,302,240 A 4/1994 Hori et al.
5,305,312 A 4/1994 Fornek et al.
5,341,374 A 8/1994 Lewen et al.
5,354,709 A 10/1994 Lorenzo et al.
5,446,814 A 8/1995 Kuo et al.
5,504,341 A 4/1996 Glavish
5,578,909 A 11/1996 Billen
5,604,352 A * 2/1997 Schuetz ..... 250/492.3
5,608,263 A 3/1997 Drayton et al.
5,659,228 A * 8/1997 Ueda ..... 315/505
5,663,971 A 9/1997 Carlsten
5,666,020 A 9/1997 Takemura
5,668,368 A 9/1997 Sakai et al.
5,705,443 A 1/1998 Stauf et al.
5,737,458 A 4/1998 Wojnarowski et al.
5,744,919 A 4/1998 Mishin et al.
5,757,009 A 5/1998 Walstrom
5,767,013 A 6/1998 Park
5,780,970 A 7/1998 Singh et al.
5,790,585 A 8/1998 Walsh
5,811,943 A 9/1998 Mishin et al.
5,821,836 A 10/1998 Katehi et al.
5,821,902 A 10/1998 Keen
5,825,140 A 10/1998 Fujisawa
5,831,270 A 11/1998 Nakasuji
5,847,745 A 12/1998 Shimizu et al.
5,889,449 A 3/1999 Fiedziuszko
5,889,797 A 3/1999 Nguyen
5,902,489 A 5/1999 Yasuda et al.
5,963,857 A 10/1999 Greywall
5,972,193 A 10/1999 Chou et al.
6,005,347 A 12/1999 Lee
6,008,496 A 12/1999 Winefordner et al.
6,040,625 A 3/2000 Ip
6,060,833 A 5/2000 Velazco
6,080,529 A 6/2000 Ye et al.
6,117,784 A 9/2000 Uzoh
6,139,760 A 10/2000 Shim et al.
6,180,415 B1 1/2001 Schultz et al.
6,195,199 B1 2/2001 Yamada
6,222,866 B1 4/2001 Seko
6,278,239 B1 8/2001 Caporaso et al.
6,281,769 B1 8/2001 Fiedziuszko
6,297,511 B1 10/2001 Syllaios et al.
6,301,041 B1 10/2001 Yamada
6,309,528 B1 10/2001 Taylor et al.
6,316,876 B1 11/2001 Tanabe
6,338,968 B1 1/2002 Hefti
6,370,306 B1 4/2002 Sato et al.
6,373,194 B1 4/2002 Small
6,376,258 B2 4/2002 Hefti
6,407,516 B1 6/2002 Victor
6,441,298 B1 8/2002 Thio
6,448,850 B1 9/2002 Yamada
6,453,087 B2 9/2002 Frish et al.
6,470,198 B1 10/2002 Kintaka et al.
6,504,303 B2 1/2003 Small
6,525,477 B2 2/2003 Small
6,534,766 B2 3/2003 Abe et al.
6,545,425 B2 4/2003 Victor
6,552,320 B1 4/2003 Pan
6,577,040 B2 6/2003 Nguyen
6,580,075 B2 6/2003 Kametani et al.
6,603,781 B1 8/2003 Stinson et al.
6,603,915 B2 8/2003 Glebov et al.
6,624,916 B1 9/2003 Green et al.
6,636,185 B1 10/2003 Spitzer et al.
6,636,534 B2 10/2003 Madey et al.
6,636,653 B2 10/2003 Miracky et al.
6,640,023 B2 10/2003 Miller et al.
6,642,907 B2 11/2003 Hamada et al.
6,687,034 B2 2/2004 Wine et al.

6,700,748 B1 3/2004 Cowles et al.
6,724,486 B1 4/2004 Shull et al.
6,738,176 B2 5/2004 Rabinowitz et al.
6,741,781 B2 5/2004 Furuyama
6,777,244 B2 8/2004 Pepper et al.
6,782,205 B2 8/2004 Trisnadi et al.
6,791,438 B2 9/2004 Takahashi et al.
6,800,877 B2 10/2004 Victor et al.
6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,470,920 B2 12/2008 Gorrell et al.
7,473,917 B2 1/2009 Singh
7,586,097 B2 9/2009 Gorrell et al.
7,586,167 B2 9/2009 Gorrell et al.
2001/0002315 A1 5/2001 Schultz et al.
2001/0025925 A1 10/2001 Abe et al.
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016421 A1 1/2003 Small
2003/0034535 A1 2/2003 Barenburu et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0243925 A1* 11/2006 Barker et al. ..... 250/504 R
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.
2007/0154846 A1 7/2007 Gorrell et al.
2007/0194357 A1 8/2007 Oohashi et al.
2007/0200940 A1 8/2007 Gruhlke et al.

| | | | |
|---|---|---|---|
| 2007/0238037 | A1 | 10/2007 | Wuister et al. |
| 2007/0252983 | A1 | 11/2007 | Tong et al. |
| 2007/0258492 | A1 | 11/2007 | Gorrell |
| 2007/0258689 | A1 | 11/2007 | Gorrell et al. |
| 2007/0258690 | A1 | 11/2007 | Gorrell et al. |
| 2007/0259641 | A1 | 11/2007 | Gorrell |
| 2007/0264023 | A1 | 11/2007 | Gorrell et al. |
| 2007/0264030 | A1 | 11/2007 | Gorrell et al. |
| 2007/0282030 | A1 | 12/2007 | Anderson et al. |
| 2007/0284527 | A1 | 12/2007 | Zani et al. |
| 2008/0069509 | A1 | 3/2008 | Gorrell et al. |
| 2008/0302963 | A1 | 12/2008 | Nakasuji et al. |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sept. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
U.S. Appl. No. 11/418,082, filed May 5, 2006, Gorrell et al.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
"Array of Nanoklystrons for Frequency Agility or Redundancy," NASA's Jet Propulsion Laboratory, NASA Tech Briefs, NPO-21033. 2001.
"Antenna Arrays." May 18, 2002. www.tpub.com/content/neets/14183/css/14183_159.htm.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.

Grishin, Yu. A. et al., "Pulsed Orotron—A New Microwave Source for Submillimeter Pulse High -Field Electron Paramagnetic Resonance Spectroscopy," Review of Scientific Instruments, Sep. 2004, pp. 2926-2936, vol. 75 No. 9, American Institute of Physics.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.
Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA, Nov. 1995, pp. 117-121.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in CI2/O2 and O2 glow discharges," J. Vac. Sci, Technol. B. 17 (5), Sep./Oct. 1999, American Vacuum Society, pp. 2204-2209.
Phototonics Research, "Surface-Plasmon-Enhanced Random Laser Demonstrated," Phototonics Spectra, Feb. 2005, pp. 112-113.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.
Markoff, John, "A Chip That Can Transfer Data Using Laser Light," The New York Times, Sep. 18, 2006.
S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
"An Early History—Invention of the Klystron," http://varianinc.com/cgi-bin/advprint/print.cgi?cid=KLQNPPJJFJ, printed on Dec. 26, 2008.

"An Early History—The Founding of Varian Associates," http://varianinc.com/cgi-bin/advprint/print.cgi?cid=KLQNPPJJFJ, printed on Dec. 26, 2008.
"Chapter 3 E-Ray Tube," http://compepid.tuskegee.edu/syllabi/clinical/small/radiology/chapter..., printed from tuskegee.edu on Dec. 29, 2008.
"Diagnostic imaging modalities—Ionizing vs non-ionizing radiation," http://info.med.yale.edu/intmed/cardio/imaging/techniques/ionizing_v..., printed from Yale University School of Medicine on Dec. 29, 2008.
"Frequently Asked Questions," Luxtera Inc., found at http://www.luxtera.com/technology_faq.htm, printed on Dec. 2, 2005, 4 pages.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Making E-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"Notice of Allowability" mailed on Jan. 17, 2008 in U.S. Appl. No. 11/418,082, filed May 5, 2006.
"Technology Overview," Luxtera, Inc., found at http://www.luxtera.com/technology.htm, printed on Dec. 2, 2005, 1 page.
"The Reflex Klystron," http://www.fnrfscience.cmu.ac.th/theory/microwave/microwave%2, printed from Fast Netoron Research Facilty on Dec. 26, 2008.
"x-ray tube," http://www.answers.com/topic/x-ray-tube, printed on Dec. 29, 2008.
Corcoran, Elizabeth, "Ride the Light," Forbes Magazine, Apr. 11, 2005, pp. 68-70.
Neo et al., "Smith-Purcell Radiation from Ultraviolet to Infrared Using a Si-field Emitter" Vacuum Electronics Conference, 2007, IVEC '07, IEEE International May 2007.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Search Report and Writen Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27—F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/418,096—Jun. 23, 2009 PTO Office Action.
U.S. Appl. No. 11/433,486—Jun. 19, 2009 PTO Office Action.
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.
May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
European Search Report mailed Mar. 3, 2009 in European Application No. 06852028.7.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.

U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,082—Jan. 17, 2007 PTO Office Action.
U.S. Appl. No. 11/418,083—Jun. 20, 2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith—Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).

* cited by examiner

SINGLE LAYER CONSTRUCTION FOR ULTRA SMALL DEVICES

CROSS-REFERENCE TO CO-PENDING APPLICATIONS

The present invention is related to the following U.S. Patent applications: (1) U.S. patent application Ser. No. 11/238,991, filed Sep. 30, 2005, entitled "Ultra-Small Resonating Charged Particle Beam Modulator"; (2) U.S. patent application Ser. No. 10/917,511, filed on Aug. 13, 2004, entitled "Patterning Thin Metal Film by Dry Reactive Ion Etching"; (3) U.S. application Ser. No. 11/203,407, filed on Aug. 15, 2005, entitled "Method Of Patterning Ultra-Small Structures"; (4) U.S. application Ser. No. 11/243,476, filed on Oct. 5, 2005, entitled "Structures And Methods For Coupling Energy From An Electromagnetic Wave"; (5) U.S. application Ser. No. 11/243,477, filed on Oct. 5, 2005, entitled "Electron beam induced resonance,", (6) U.S. application Ser. No. 11/325,432, entitled "Resonant Structure-Based Display," filed on Jan. 5, 2006; (7) U.S. application Ser. No. 11/325,571, entitled "Switching Micro-Resonant Structures By Modulating A Beam Of Charged Particles," filed on Jan. 5, 2006; (8) U.S. application Ser. No. 11/325,534, entitled "Switching Micro-Resonant Structures Using At Least One Director," filed on Jan. 5, 2006; (9) U.S. application Ser. No. 11/350,812, entitled "Conductive Polymers for the Electroplating", filed on Feb. 10, 2006; (10) U.S. application Ser. No. 11/302,471, entitled "Coupled Nano-Resonating Energy Emitting Structures," filed on Dec. 14, 2005; (11) U.S. application Ser. No. 11/325,448, entitled "Selectable Frequency Light Emitter", filed on Jan. 5, 2006; and (12) U.S. application Ser. No. 11/418,086, entitled "Method For Coupling Out Of A Magnetic Device", filed on even date herewith, which are all commonly owned with the present application, the entire contents of each of which are incorporated herein by reference.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF THE DISCLOSURE

This disclosure relates to producing and using ultra-small metal structures formed by using a combination of various coating, etching and electroplating processing techniques and accomplishing these processing techniques using a single conductive layer, and to the formation of ultra small structures on a substrate that can resonate at two or more different frequencies on the single layer. The frequencies can vary between micro-wave and ultra-violet electromagnetic radiation, and preferably will produce visible light in two or more different frequencies or colors that can then be used for a variety of purposes including data exchange and the production of useful light.

INTRODUCTION AND SUMMARY

In its broadest form, the process disclosed herein produces ultra-small structures with a range of sizes described as micro- or nano-sized. The processing begins with a non-conductive substrates (e.g., glass, oxidized silicon, plastics and many others) or a semi-conductive substrate (e.g., doped silicon, compound semiconductor materials (GaAs, InP, GaN, . . . )), or a conductive substrate. The optimal next step can be the coating or formation of a thin layer of nickel followed by the coating or formation of a thin layer of silver on the nickel layer. Then a single layer of a conductive material, such as silver, gold, nickel, aluminum, or other conductive material is then applied, deposited, coated or otherwise provided on the thin silver layer, and the conductive layer is then etched or patterned into the desired ultra-small shaped devices, or the substrate, on which the thin nickel and silver layers had been coated, is provided with a mask layer which is patterned and then a conductive material is deposited, plated or otherwise applied. Thereafter, the mask layer can be removed, although in some instances that may not be necessary.

Electroplating is well known and is fully described in the above referenced '407 application. For present purposes, electroplating is the preferred process to employ in the construction of ultra-small resonant structures.

An etching could also be used, for example by use of chemical etching or Reactive Ion Etching (RIE) techniques, as are described in the above mentioned '511 application, to develop a final pattern in the conductive layer.

Where a photoresist material is first applied to the substrate, and patterned, then a coating or plating process as is explained in the above mentioned '407 application could be used. In that case, the patterned base structure will be positioned in an electroplating bath and a desired metal will be deposited into the holes formed in the mask or protective layer exposed by one or more of the prior etching processing steps. Thereafter, the mask or photoresist layer can be removed leaving formed metal structures on the substrate exhibiting an ultra small size, or alternatively the PR layer will be removed leaving the formed metal structures lying directly on the substrate.

Ultra-small structures encompass a range of structure sizes sometimes described as micro- or nano-sized. Objects with dimensions measured in ones, tens or hundreds of microns are described as micro-sized. Objects with dimensions measured in ones, tens or hundreds of nanometers or less are commonly designated nano-sized. Ultra-small hereinafter refers to structures and features ranging in size from hundreds of microns in size to ones of nanometers in size.

GLOSSARY

As used throughout this document:

The phrase "ultra-small resonant structure" shall mean any structure of any material, type or microscopic size that by its characteristics causes electrons to resonate at a frequency in excess of the microwave frequency.

The term "ultra-small" within the phrase "ultra-small resonant structure" shall mean microscopic structural dimensions and shall include so-called "micro" structures, "nano" structures, or any other very small structures that will produce resonance at frequencies in excess of microwave frequencies.

BRIEF DESCRIPTION OF FIGURES

The invention is better understood by reading the following detailed description with reference to the accompanying drawings in which.

DESCRIPTION OF THE PRESENTLY PREFERRED EXEMPLARY EMBODIMENTS OF THE INVENTION

Figure 1:
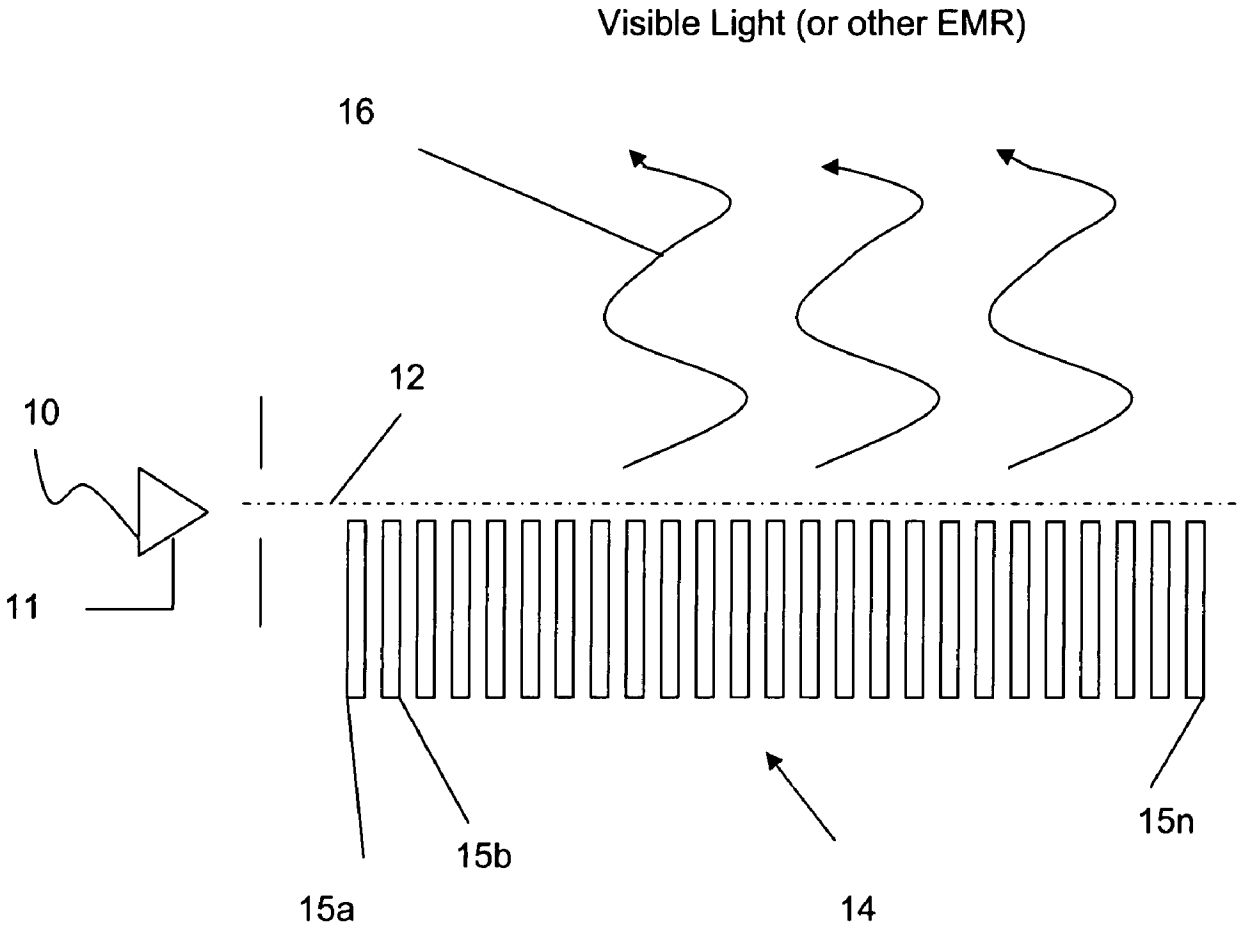
FIG. 1 is a schematic diagram of a first example and embodiment of the present invention.

As shown in FIG. 1, a single layer of metal, such as silver or other thin metal, is produced with the desired pattern or otherwise processed to create a number of individual resonant structures to form a resonant element 14. Although sometimes referred to herein as a "layer" of metal, the metal need not be a contiguous layer, but can be a series of structures or, for example, posts or fingers 15 that are individually present on a substrate 13 (such as a semiconductor substrate or a circuit board) and area designated as 15A, 15*b*, . . . 15*n*.

When forming the posts 15, while the posts 15 can be isolated from each other, there is no need to remove the metal between posts or fingers 15 all the way down to the substrate level, nor does the plating have to place the metal posts directly on the substrate, but rather they can be formed on the thin silver layer or the silver/nickel layer referenced above which has been formed on top of the substrate, for example. That is, the posts or fingers 15 may be etched or plated in a manner so a layer of conductor remains beneath, between and connecting the posts. Alternatively, the posts or fingers can be conductively isolated from each other by removing the entire metal layer between the posts, or by not even using a conductive layer under the posts or fingers. In one embodiment, the metal can be silver, although all other conductors and conductive materials, and even dielectrics, are envisioned as well.

A charged particle beam, such as an electron beam 12 produced by an electron microscope, cathode, or any other electron source 10, that is controlled by applying a signal on a data input line 11. The source 10 can be any desired source of charged particles such as an electron gun, a cathode, an electron source from a scanning electron microscope, etc. The passing of such an electron beam 12 closely by a series of appropriately-sized resonant structures 15, causes the electrons in the structures to resonate and produce visible light or other EMR 16, including, for example, infrared light, visible light or ultraviolet light or any other electromagnetic radiation at a wide range of frequencies, and often at a frequency higher than that of microwaves. In FIG. 1, resonance occurs within the metal posts 15 and in the spaces between the metal posts 15 on a substrate 13 and with the passing electron beam. The metal posts 15 include individual post members 15*a*, 15*b*, . . . 15*n*. The number of post members 15*a* . . . 15*n* can be as few as one and as many as the available real estate permits. We note that theoretically the present resonance effect can occur in as few as only a single post, but from our practical laboratory experience, we have not measured radiation from either a one post or two post structures. That is, more than two posts have been used to create measurable radiation using current instrumentation.

The spaces between the post members 15*a*, 15*b*, . . . 15*n* (FIG. 1) create individual cavities. The post members and/or cavities resonate when the electron beam 12 passes by them. By choosing different geometries of the posts and resonant cavities, and the energy (velocity) of the electron beam, one can produce visible light (or non-visible EMR) 16 of a variety of different frequencies including, for example, a variety of different colors in the case of visible emissions, from just a single patterned metal layer.

Figure 2:
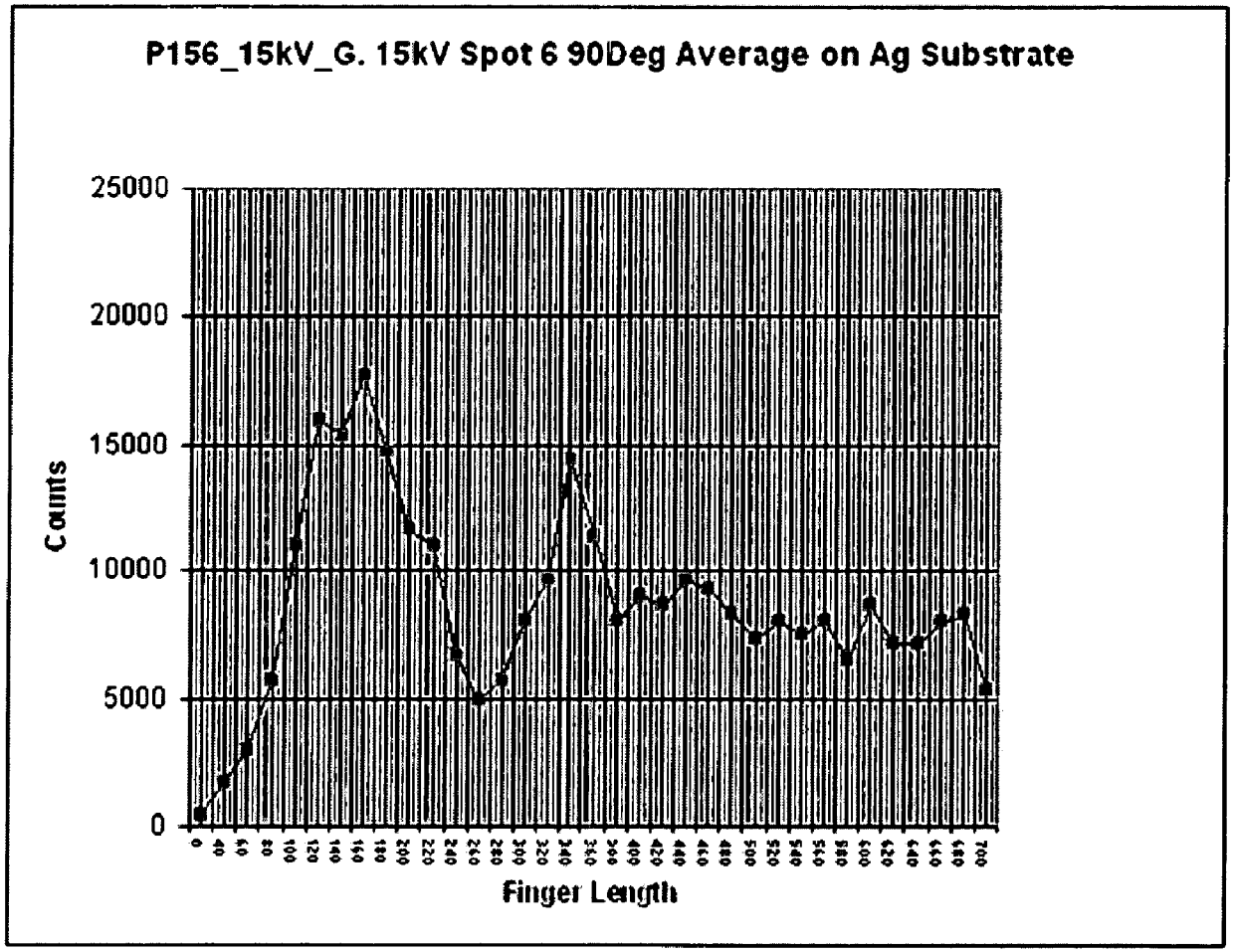
FIG. 2 is a graph showing intensity versus post or finger length for the series of rows of ultra small structures.

That resonance is occurring can be seen in FIG. 2. There, the average results of a set of experiments in which the radiation intensity from an example of the present invention was plotted (in the y-axis, labeled "counts" of photons, and measured by a photo multiplier tube as detected current pulses) versus the length of the fingers or posts 15 that are resonating (in the x-axis, labeled as "finger length"). The intensity versus finger or post length average plot shows two peaks (and in some experimental results with more intense outputs, a third peak was perhaps, though not conclusively, present) of radiation intensity at particular finger lengths. For additional discussion, reference can be made to U.S. application Ser. No. 11/243,477, previously referenced above, and which is, in its entirety, incorporated herein by reference. We conclude that certain finger lengths produce more intensity at certain multiple lengths due to the resonance effect occurring within the posts 15.

Exemplary resonant structures are illustrated in several copending applications, including U.S. application Ser. No. 11/325,432, noted above and is, in its entirety, incorporated herein by reference. As shown in FIG. 1, the resonant element 14 is comprised a series of posts or fingers 15 which are separated by a spacing 18 measured as the beginning of one finger 15*a* to the beginning of an adjacent finger 15*b*. Each post 15 also has a thickness that takes up a portion of the spacing between posts 15. The posts 15 also have a length 125 and a height (not shown). As illustrated, the posts of FIG. 1 are perpendicular to the beam 12. As demonstrated in the above co-pending application, the resonant structures can have a variety of shapes not limited to the posts 15 shown in FIG. 2 herein, and all such shape variations are included herein.

Resonant structures, here posts 15, are fabricated from resonating material (e.g., from a conductor such as metal (e.g., silver, gold, aluminum and platinum or from an alloy) or from any other material that resonates in the presence of a charged particle beam). Other exemplary resonating materials include carbon nanotubes and high temperature superconductors.

When creating the resonating elements 14, and the resonating structures 15, according to the present invention, the various resonant structures can be constructed in multiple layers of resonating materials but are preferably constructed in a single layer of resonating material as described hereinafter.

In one single layer embodiment, all the resonant structures 15 of a resonant element 14 are formed by being etched, electroplated or otherwise formed and shaped in the same processing step.

At least in the case of silver, etching does not need to remove the material between segments or posts all the way down to the substrate level, nor does the plating have to place the posts directly on the substrate. Silver posts can be on a silver layer on top of the substrate. In fact, we discovered that, due to various coupling effects, better results are obtained when the silver posts are set on a silver layer, which itself is on the substrate.

As noted previously, the shape of the posts 15 may also be shapes other than rectangles, such as simple shapes (e.g., circles, ovals, arcs and squares), complex shapes (e.g., such as semi-circles, angled fingers, serpentine structures and embedded structures (i.e., structures with a smaller geometry within a larger geometry, thereby creating more complex resonances)) and those including waveguides or complex cavities. The finger structures, regardless of any particular shape, will be collectively referred to herein as "segments."

Figure 3:
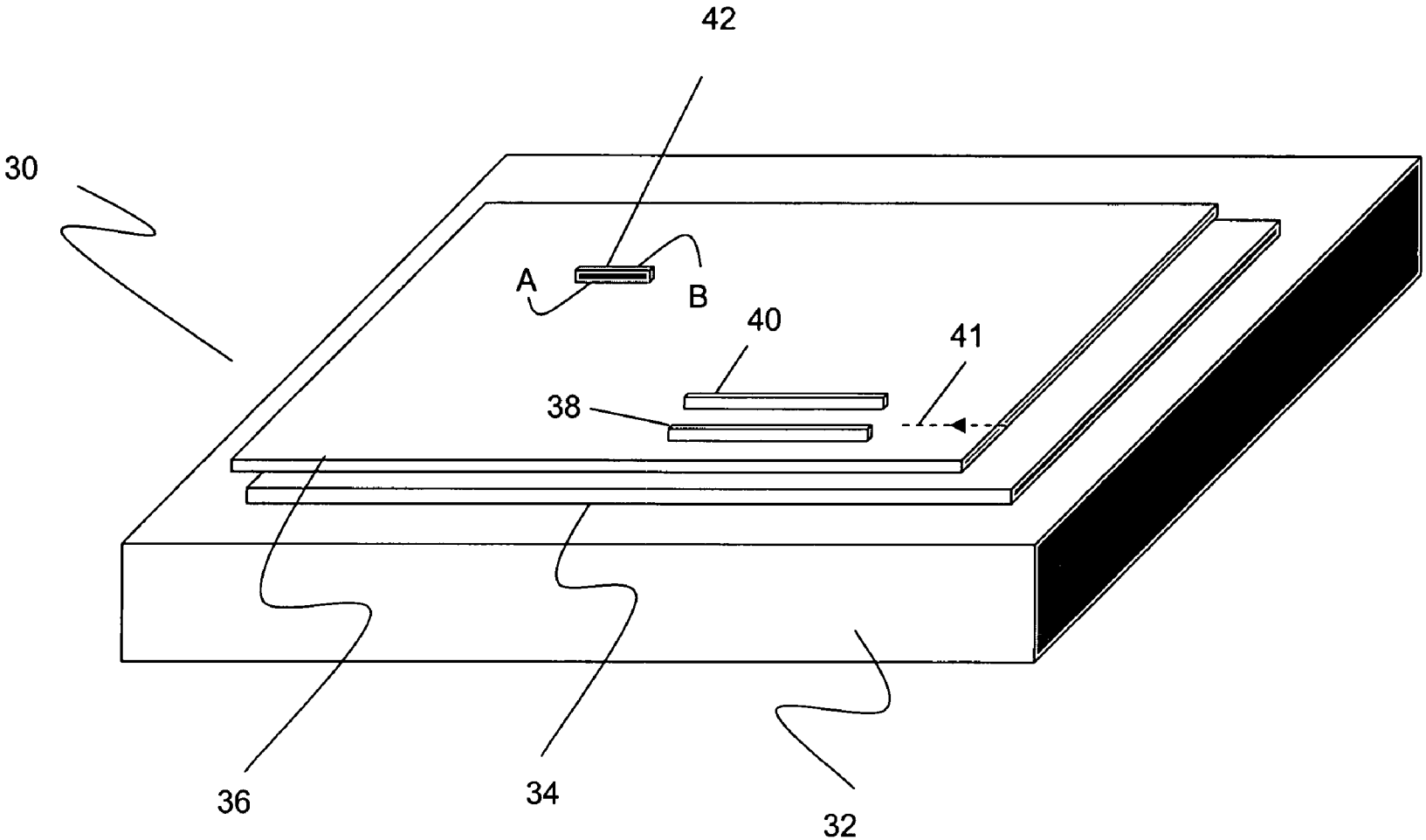
FIG. 3 is a perspective view of another embodiment of the present invention.

Turning now to specific exemplary embodiments, for example a chip 30 as shown in FIG. 3, can be comprised of a substrate 32 that has been provided with a thin layer of nickel 34, or other adhesive layer or material, at, for example, a thickness of about 10 nm, and a layer of silver 36 having, for example, a thickness of about 100 nm. As shown, the chip 30 includes two rows 38 and 40 of posts or periodic structures, preferably adjacent one another, each being comprised of a plurality of ultra-small structures or segments, which collectively comprise an array of ultra small structures, a resonating element, which will resonate at two different frequencies. For example, one row could be arranged to resonate at one frequency while the other could be arranged to resonate at another and different frequency. As explained above, and in the above copending applications, the ultra-small structures in rows 38 and 40 can be formed by etching or plating techniques, and can have a wide variety of shapes and sizes, with a variety of spacing there between and a variety of heights. Through a selection of these parameters as obtained by such processing techniques, and with reference to what is desired to be accomplished, a chip 30 can be provided, for example, with a row of a plurality of ultra-small structures that will produce, for example, green light and another row, for example, that could produce and output, such as, for example, red light. It must be understood and appreciated that the light or other EMR being emitted by rows 38 and 40, when energized or excited by a beam of charged particles as is shown at 41, is desirably achieved by having the emission of energy be at any two different frequencies, whether in the visible light spectrum, the microwave spectrum, the infra-red spectrum or some other energy spectrum. The invention centers around having ultra small structures formed in one layer of a conductive material, and either isolated or connected as discussed herein, so that they will resonate at two or more different frequencies.

The present invention is not limited to having only one array comprised of two rows of ultra-small structures. For example, the invention contemplates having a single row 42 comprised of a plurality of the ultra-small resonant structure, but with the row 42 having two different sections, A and B formed of different ultra-small resonant structures, with the A section resonating at one frequency while the B section resonates at a different frequency. In this instance, the two sections, A and B, will emit energy at different frequencies even though they are contained in one row of structures. Also, the present invention could, for example, also encompass a device, such as a chip, where its surface is completely filled with or occupied by various arrays of ultra-small structures each of which could be identical to one another, where each was different, or where there were patterns of similar and dissimilar arrays each of which could be emitting or receiving energy or light at a variety of frequencies according to the pattern designed into the arrays of ultra small structures. The processing techniques discussed and disclosed herein, and in the above referenced applications incorporated herein by reference, permit production of any order, design, type, shape, arrangement, size and placement of arrays, elements, posts, segments and/or ultra-small structures, or any grouping thereof, as a designer may wish, in order to achieve an input, output onto or from the surface of the chip to provide light, data transfer or other information or data into or out of the chip or both, or between different parts of a chip or adjacent chips.

Figure 4:
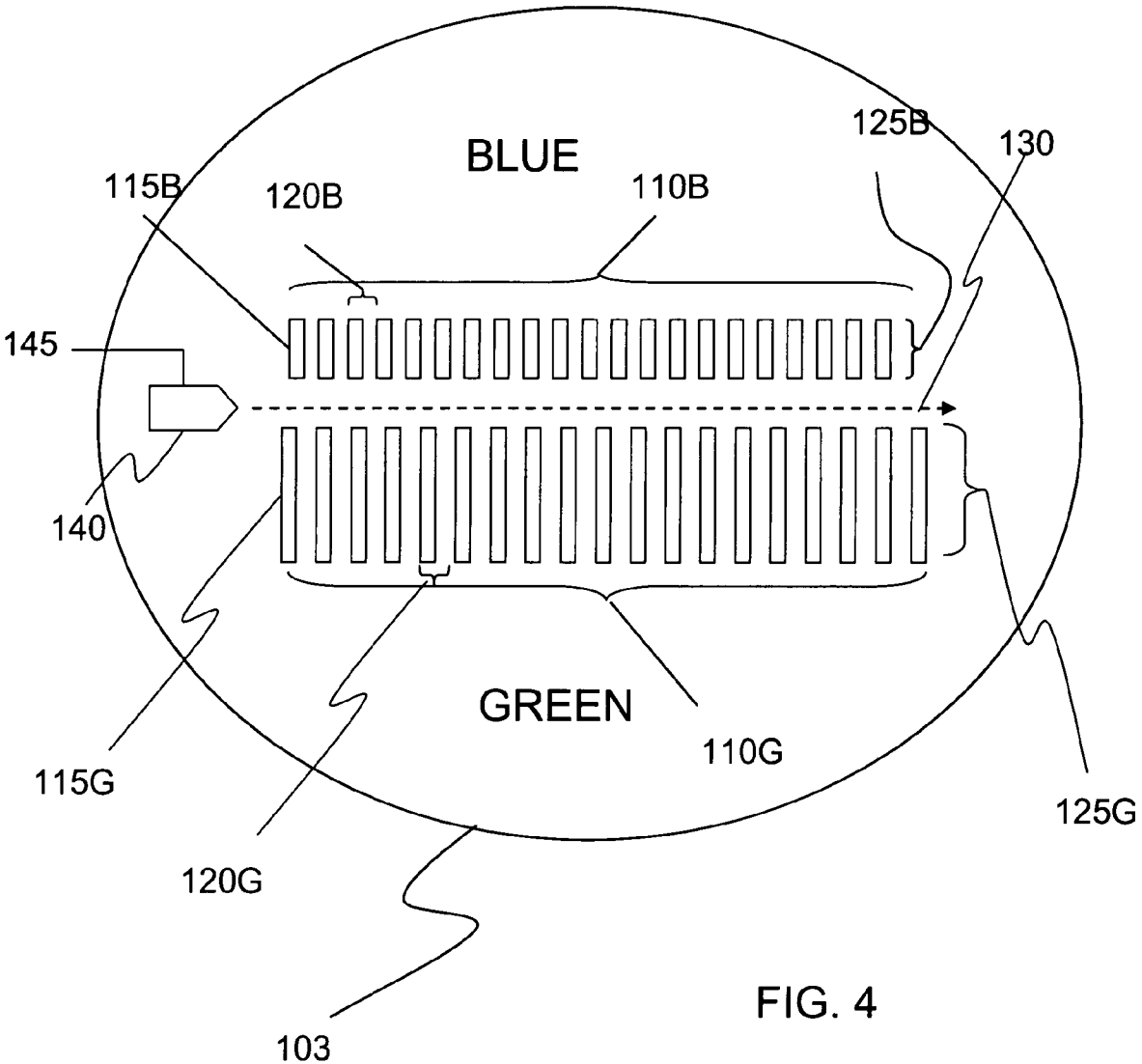
FIG. 4 is a view of another embodiment of the present invention.

Another exemplary array of resonant elements is shown in FIG. 4, where one wavelength element 110B, comprised of posts or fingers 115B, with a spacing between posts or fingers shown at 120B, lengths at 125B and heights (not shown), for producing electromagnetic radiation with a first frequency, for example a blue color, has been constructed on a substrate 103 so as to be on one side of a beam 130 of charged particles (e.g., electrons, or positively of negatively charged ions) and a second wavelength element 110G, comprised of posts or fingers 115G, with a spacing between posts or fingers shown at 120G, lengths at 125G and heights (not shown), for producing electromagnetic radiation with a second frequency, for example a green color, has been constructed on a substrate 103 so as to be the opposite side of the beam 130. It should be understood that other forms of these wavelength elements could be formed, including using a wavelength element that would produce a red color could be used in place of either the blue or green elements, or that combination elements comprised of ultra small structures that would produce a variety of colors could also be used. However, the spacing and lengths of the fingers 115G and 115B of the resonant structures 110G and 110B, respectively, are for illustrative purposes only and are not intended to represent any actual relationship between the period or spacing 120 of the fingers, the lengths of the fingers 115 and the frequency of the emitted electromagnetic radiation. However, the dimensions of exemplary resonant structures are provided in Table 1 below including for red light producing structures.

TABLE 1

| Wave-length | Period 120 | Segment thickness | Height | Length 125 | # of fingers in a row |
|---|---|---|---|---|---|
| Red | 220 nm | 110 nm | 250-400 nm | 100-140 nm | 200-300 |
| Green | 171 nm | 85 nm | 250-400 nm | 180 nm | 200-300 |
| Blue | 158 nm | 78 nm | 250-400 nm | 60-120 nm | 200-300 |

As dimensions (e.g., height and/or length) change, the intensity of the radiation may change as well. Moreover, depending on the dimensions, harmonics (e.g., second and third harmonics) may occur. For post height, length, and width, intensity appears oscillatory in that finding the optimal peak of each mode created the highest output. When operating in the velocity dependent mode (where the finger period depicts the dominant output radiation) the alignment of the geometric modes of the fingers are used to increase the output intensity. However it is seen that there are also radiation components due to geometric mode excitation during this time, but they do not appear to dominate the output. Optimal overall output comes when there is constructive modal alignment in as many axes as possible.

Figure 5:
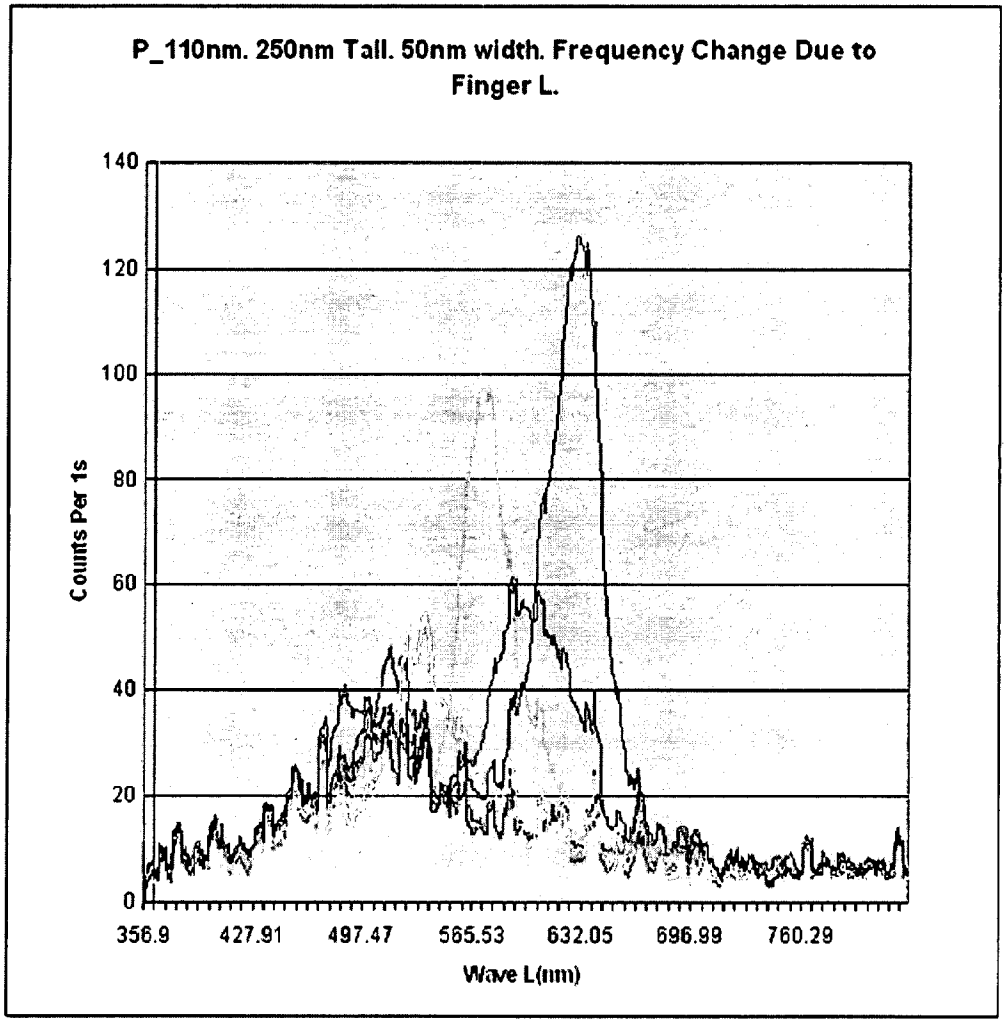
FIG. 5 is a graph showing an example of intensity and wavelength versus finger or post length for a series of ultra small structures.

We have also detected that, unlike the general theory on Smith-Purcell radiation, which states that frequency is only dependant on period and electron beam characteristics (such as beam intensity), the frequency of our detected beam changes with the finger length. Thus, as shown in FIG. 5, the frequency of the electromagnetic wave produced by the system on a row of 220 nm fingers (posts) has a recorded intensity and wavelength greater than at the lesser shown finger lengths. With Smith-Purcell, the frequency is related to the period of the grating (recalling that Smith-Purcell is produced by a diffraction grating) and beam intensity according to:

$$\lambda = \frac{L}{|n|} \cdot \left(\frac{1}{\beta} - \sin\theta\right)$$

where λ is the frequency of the resonance, L is the period of the grating, n is a constant, β is related to the speed of the electron beam, and θ is the angle of diffraction of the electron.

Each of the dimensions mentioned above can be any value in the nanostructure range, i.e., 1 nm to 1 μm. Within such parameters, a series of posts can be constructed that output substantial EMR in the infrared, visible and ultraviolet portions of the spectrum and which can be optimized based on alterations of the geometry, electron velocity and density, and metal/layer type. It should also be possible to generate EMR of longer wavelengths as well. Unlike a Smith-Purcell device, the resultant radiation from such a structure is intense enough to be visible to the human eye with only 30 nanoamperes of current.

Figure 6:
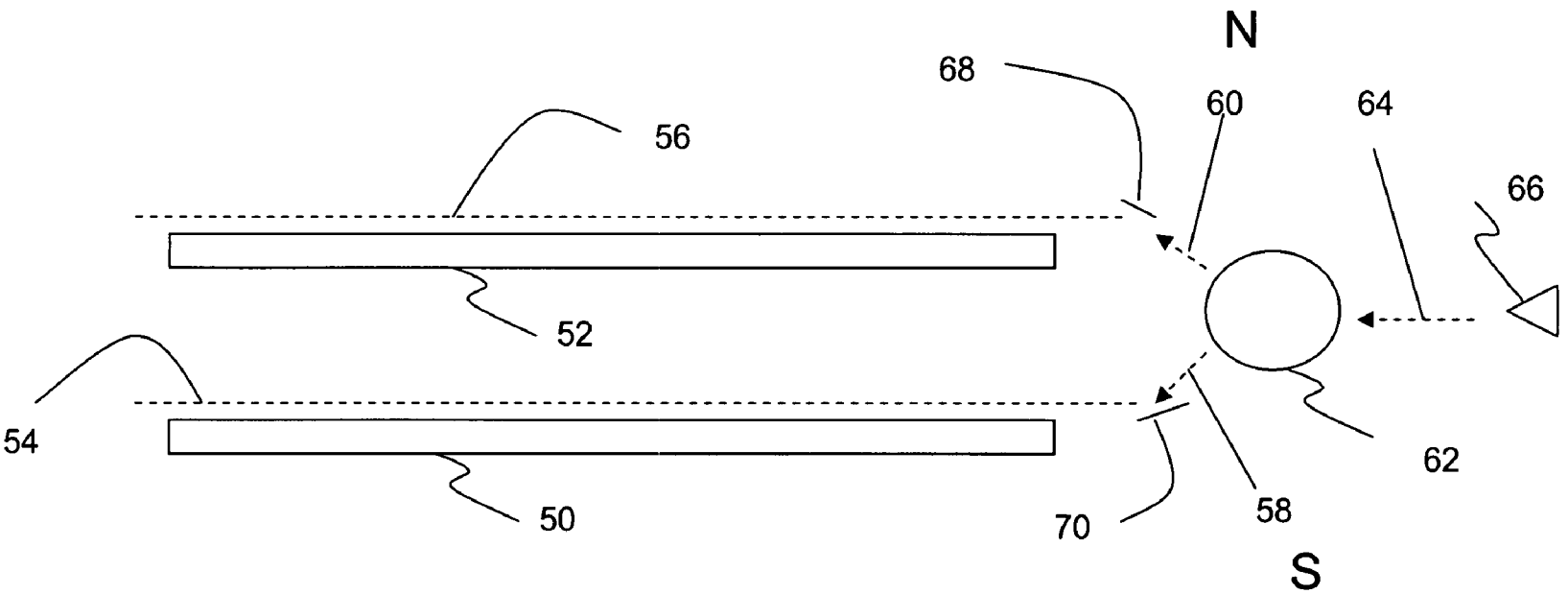
FIG. 6 an example of another embodiment of the present invention.

FIG. 6 shows another exemplary embodiment of the present invention where two rows comprised of a plurality of resonating structures, 50 and 52, can be arranged in two parallel rows, or alternatively the rows can be arranged at any desired angle. A charged particle beam 54 and 56 are directed past the rows 50 and 52, respectively by the operation of a magnetic element/cell 62 which can be in one of two states, referred to here as "N" and "S". Such a magnetic element/cell 62 is also referred to herein as a bi-state device or cell or element. A beam 64 of charged particles (emitted by an emitter 66—a source of charged particles) is deflected by the magnetic element 62, depending upon and according to the state of the magnetic element. When the magnetic element 62 is in its so-called "N" state, the particle beam 64 will be deflected in the N direction, along path 60 to a reflector 68 which then deflects the beam along a path 56 parallel to row 52. When the magnetic element 62 is in its so-called "S" state, the particle beam 64 will be deflected in the S direction along a path 58 toward a reflector 70 that then deflects the beam among a path 54 parallel to row 50. It should be understood that rows 50 and 52 could be angled to be parallel with beam paths 58 and 60, respectively, or at any other angle with deflectors 70 and 68 being appropriately angled to direct the beam along the row of resonating elements.

For the sake of this description, the drawings show the particle beam traveling in both the N and the S directions. Those of skill in the art will immediately understand that the charged particle beam will only travel in one of those directions at any one time.

Figure 7:
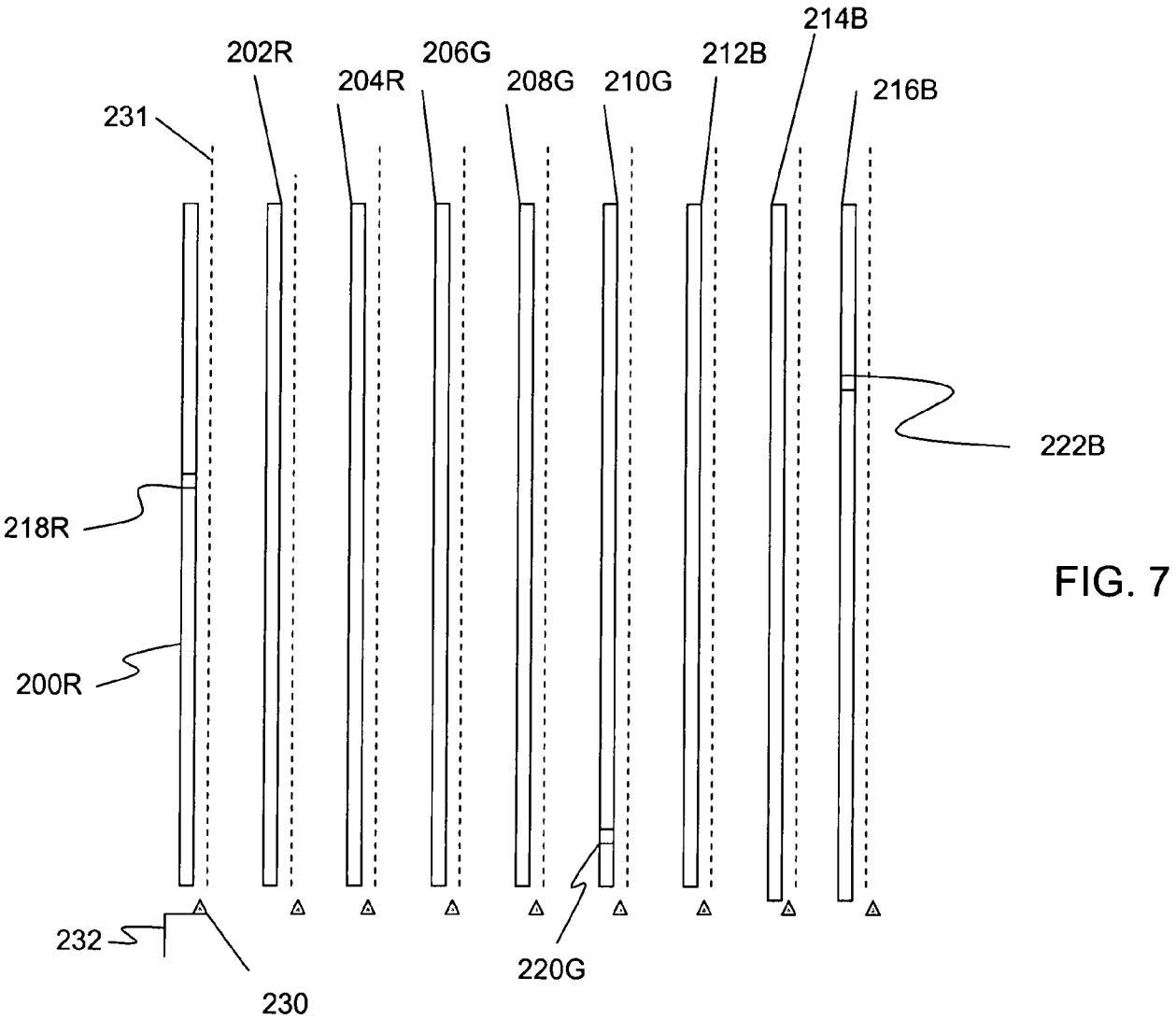
FIG. 7 is another embodiment of the present invention.

FIG. 7 shows another embodiment where a plurality of rows of wavelength elements 200R-216B have been formed as a composite array on a substrate 106 so that all three visible light spectrums can be produced by the array (i.e., red, green and blue). The spacings between and the lengths of the fingers or posts being used, 218R, 220G, and 222B of the resonant structures 200R-204R, 206G-210G, and 212B-216B, respectively, are for illustrative purposes only, and are not intended to represent any actual relationship between the period or spacings between the fingers or posts, the length of the fingers or posts and the frequency of the emitted electromagnetic radiation. Reference can be made to Table 1 above for specifics concerning these parameters.

As shown in FIG. 7, each row of resonant structures 200R-216B can include its own source of charged particles 232, or as discussed above concerning FIG. 6 a magnetic element or other forms of beam deflectors, as referenced in the above related applications, which have been incorporated herein, can be used to direct beams of charged particles past these rows of resonating structures. It should also be understood that rows 200R, 202R and 204R, for example, could be formed so that each produced exactly the same color and shade of red, or each could be formed to produce a different shade of that color, for example light red, medium red and/or dark red. This concept of having color shading applies equally as well to the green and blue portions of the array.

Each row 200R-216B will produce a uniform light output, yet the combination of the plurality of rows, and the plurality of fingers or posts in each row, permits each row to be controlled so that the whole array can be tuned or constructed, by a choice of the parameters mentioned herein and in the above noted co-pending applications, to produce the light or other EMR output desired.

It should also be understood that the present invention is not limited to having three rows of each of three colors, but rather to the concept of having at least a sufficient number of ultra small structures that will produce two different frequencies on the same surface at the same time. Thus, the chip or what ever other substrate is to be used, could have, and the invention contemplates, all possible combinations of ultra small structures whether in individual rows, adjacent rows or non-adjacent rows, as well as all combinations of colors and shadings thereof as are possible to produce, as well as all possible combinations of the production of frequencies in other or mixed spectrums. Further, the surface can have a limited number of ultra small structures that will accomplish that objective including, as well, as many rows and as many ultra small structure as the surface can hold, including individual rows each of which are comprised of a plurality of different ultra small structures.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An array of ultra-small structures on a surface, comprising:

a substrate;

at least first and second ultra-small resonant structures formed on the substrate with the first and second ultra-small resonant structures each producing a different frequency output as a function of the different respective lengths of said first and second ultra-small resonant structures;

a conductive layer positioned beneath each of the ultra-small resonant structures; and a source of a beam of charged particles directed toward the at least first and second ultra-small resonant structures so that each ultra-small resonant structure resonates at its desired frequency.

2. The array as in claim 1 wherein said ultra-small resonant structures are comprised of a material selected from the group consisting silver (Ag), nickel (Ni), copper (Cu), aluminum (Al), gold (Au) and platinum (Pt).

3. The array as in claim 1 further including a plurality of each of the first and second ultra-small resonant structures, with the plurality of the first and second ultra-small resonant structures being spaced apart from each other.

4. The array as in claim 3 wherein the plurality of first and second ultra-small resonant structures are formed in respective rows.

5. The array as in claim 4 wherein the rows are straight.

6. The array as in claim 1 wherein said first and second ultra-small resonant structures are formed by an electroplating process.

7. The array as in claim 1 wherein said first and second ultra-small resonant structures are formed by coating and etching techniques.

8. The array as in claim 1 wherein a conductive material extends between each of the ultra-small resonant structures.

9. An array of ultra-small structures on a surface, comprising:

a substrate;

a single conductive layer;

a plurality of rows comprised of a plurality of spaced apart ultra-small resonant structures, with the ultra-small resonant structures being formed on the single conductive layer so the single conductive layer is positioned beneath each of the ultra-small resonant structures, a source of a beam of charged particles directed toward the plurality of rows of spaced apart ultra-small resonant structures with each row within the plurality of rows producing a different frequency output when energized by the beam of charged particles.

10. The array as in claim 9 wherein the substrate comprises a chip.

11. The array as in claim 9 further including a deflector to control the beam of charged particles relative to the plurality of rows.

* * * * *